United States Patent [19]

Shivers

[11] Patent Number: 4,837,825

[45] Date of Patent: Jun. 6, 1989

[54] PASSIVE AMBIENCE RECOVERY SYSTEM FOR THE REPRODUCTION OF SOUND

[76] Inventor: Clarence L. Shivers, 3055 Purgatory Dr., Colorado Springs, Colo. 80218

[21] Appl. No.: 145,284

[22] Filed: Jan. 19, 1988

Related U.S. Application Data

[63] Continuation-in-part of Ser. No. 18,357, Feb. 28, 1987, abandoned.

[51] Int. Cl.[4] ..... H04R 5/02

[52] U.S. Cl. ..... 381/24

[58] Field of Search ..... 381/18, 24, 17; 181/144, 145

[56] References Cited

U.S. PATENT DOCUMENTS

| | | | |
|---|---|---|---|
| 2,179,840 | 11/1939 | Bucky | 181/145 |
| 3,166,147 | 1/1965 | Greenfield | 181/145 |
| 3,588,355 | 6/1971 | Holm | 381/24 |
| 3,697,692 | 10/1972 | Hafler | 381/18 |
| 3,745,254 | 7/1973 | Ohta et al. | 381/18 |
| 3,757,047 | 9/1973 | Ito et al. | 381/18 |
| 3,919,478 | 11/1975 | Schott | 381/18 |
| 4,190,739 | 2/1980 | Torffield | 381/24 |
| 4,204,092 | 5/1980 | Bruney | 381/24 |
| 4,227,047 | 10/1980 | Horne | 381/24 |
| 4,230,905 | 10/1980 | Crum et al. | 381/24 |
| 4,256,922 | 3/1981 | Gorike | 181/144 |
| 4,418,243 | 11/1983 | Fixler | 181/144 |
| 4,593,784 | 6/1986 | Flanders | 181/144 |
| 4,612,663 | 9/1986 | Holbrook et al. | 381/24 |

FOREIGN PATENT DOCUMENTS

| | | | |
|---|---|---|---|
| 1356843 | 6/1974 | United Kingdom | 381/18 |

*Primary Examiner*—Forester W. Isen

*Attorney, Agent, or Firm*—Millen & White

[57] ABSTRACT

A multi-channel stereophonic system in which different audio signals are produced and caused to converge upon the ear of the listener at selectively spaced time intervals so as to enhance the realism of the sound impressed upon the listener. A pair of auxiliary speakers are arranged in front of and above a pair of conventional main speakers, and signals are transmitted from an audio source in selected phase relationship to each of the speakers, the sound produced at least by each of the auxiliary speakers being selectively reflected off of sound-reflective surfaces in order to physically separate the added sound produced by the auxiliary speakers from the conventional stereo speakers.

9 Claims, 1 Drawing Sheet

PASSIVE AMBIENCE RECOVERY SYSTEM FOR THE REPRODUCTION OF SOUND

This application is a continuation-in-part of Ser. No. 018,357, filed Feb. 28, 1987, and entitled "SHIVERS PASSIVE AMBIENCE RECOVERY SYSTEM", now abandoned.

SPECIFICATION

This invention relates to sound reproduction systems; and more particularly relates to a novel and improved system of the type described for enhancing stereophonic perception of sound upon the ear of the listener.

BACKGROUND AND FIELD OF THE INVENTION

Numerous systems have been devised for improving the quality of sound reproduced from an audio source. Typical of such systems are the stereophonic and quadraphonic systems in which two or more speakers are spaced at intervals about a room and the sound produced is radiated from different angles or loactions toward the listener. In the past, considerable attention has been given to the quality of recording the sound as well as the quality of equipment employed to refine the sound when reproduced for the listening pleasure of an audience.

One typical approach is that disclosed in U.S. Pat. No. 4,612,663 to K. A. Holbrook et al in which four speakers are arranged in a generally T-shaped configuration with left, front and right speakers in a vertical plane and a rear speaker behind that plane. The system is designed to generate both in-phase and out-of-phase signals (L-R or R-L) to the front and back speakers in order to achieve higher quality or realism in the sound. Another U.S. Pat. No. 3,757,047 to R. Ito et al utilizes signals which are generated out-of-phase with respect to one another in a loudspeaker arrangement. U.S. Pat. No. 3,697,692 to D. Hafler similarly employs out-of-phase signals with various different loudspeaker arrangements to enhance the realism of sound. U.S. Pat. No. 3,745,254 to K. Ohta et al has an arrangement of four loudspeakers operated from a two-channel source in which the four speakers are equidistantly spaced apart and receive different signals with a phase shift introduced between the signals but requires special equipment to generate the out-phase-signals.

In accordance with the present invention, it has been found that not only may the manner of generating a phase relationship between signals be greatly improved but also the spacing and location between pairs of standard stereophonic speakers and auxiliary speakers to greatly enhance the dimensional reconstruction of the sound and its effect on the listening audience.

SUMMARY OF THE INVENTION

Accordingly an object of the present invention is to provide for a novel and improved audio system for enhancing the production of sound and realism of the sound as produced in a stereophonic system.

It is another object of the present invention to provide for a novel and improved method and means for converting audio signals into a combination of direct and indirect or reflected sounds which will converge from different directions upon the ear of the listener in such a way as to create greater realism and purity of sound.

It is a further object of the present invention to provide for a novel and improved stereophonic system for developing multi-dimensional sound from a combination of in-phase and out-of-phase signals converging upon the ear of the listener from different directions.

It is an additional object of the present invention to provide for a stereophonic system in which front-to-rear sonic difference informaiton is derived from conventional left and right stereo signals through a combination of unique speaker placement, speaker direction and left and right stereo signal phase differences; and wherein a high quality stereophonic system has been devised through the utilization of low-cost speakers in combination with conventional full-range speakers.

In accordance with the present invention, there has been devised a novel and improved multi-channel stereophonic system for producing left (L) and right (R) stereo signals from an audio source wherein first and second speakers are arranged in horizontally spaced relation to one another each for producing and directing one of the left (L) and right (R) signals in a common horizontal direction, and third and fourth auxiliary speakers are positioned in front of and above the first and second speakers. Means are provided for transmitting one of the left (L) and right (R) signals in-phase both to one of the first and second speakers and to one of the third and fourth speakers, and further means are provided for transmitting the other of the left (L) and right (R) signals in-phase to the other of said first and second speakers and out-of-phase to the other of the third and fourth speakers. Accordingly, all of the signals are transmitted in-phase except for one signal which is transmitted out-of-phase to one of the third and fourth speakers. Preferably, one of the third and fourth speakers directs the sound produced by the in-phase signal at right angles to the sound produced by the out-of-phase signal delivered by the other of said third and fourth speakers, and means including a first sound-reflective surface, such as, a sidewall of a room reflects the sound from the in-phase signal and a second sound-reflective surface, such as, a ceiling at right angles to the first sound-reflective surface reflects the sound from the out-of-phase signals whereby four different signals are produced by the four speakers and converge upon the ear of the listener from different locations and at selectively spaced time intervals to enhance the realism of the sound impressed upon the listener.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
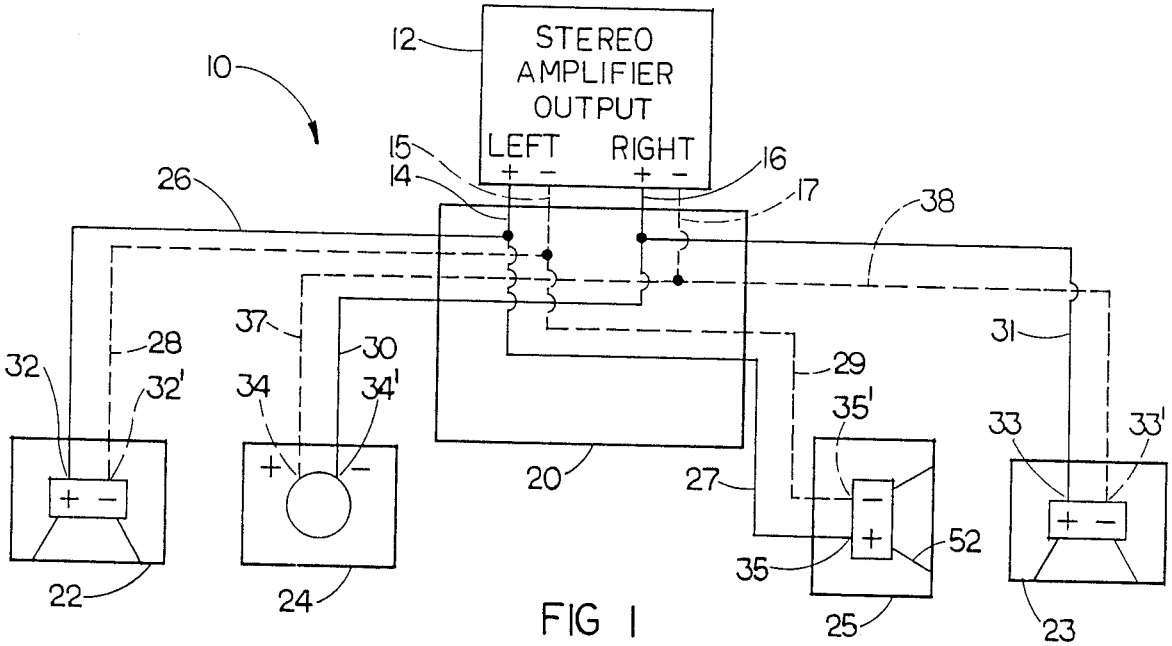
FIG. 1 is a flow diagram illustrating a preferred form of stereophonic sound system in accordance with the present invention.
Figure 2:
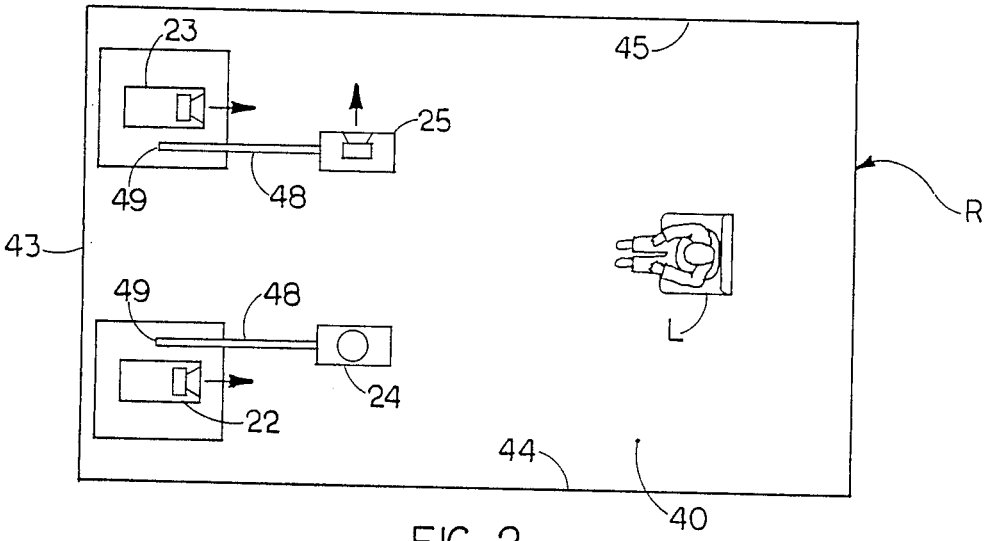
FIG. 2 is a somewhat schematic plan view of a preferred form of stereo system positioned in a room of a selected size and in predetermined relation to a listener(s) stationed in that room.
Figure 3:
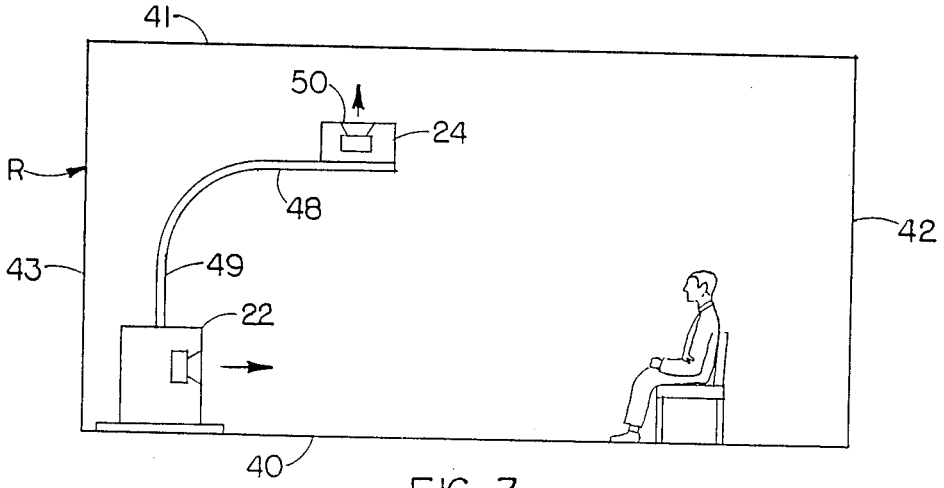
FIG. 3 is a side view in elevation of the preferred form of stereophonic system illustrated in FIG. 2.

Referring in more detail to the drawings, there is illustrated in FIGS. 1 and 2 a preferred form of sound reproduction system 10 in which an audio source, not shown, of a standard stereophonic system has a stereophonic amplifier 12 provided with left channel positive and negative output terminals 14, 15 and right channel positive and negative output terminals 16, 17, respectively. Each of the left and right terminals as described are connected via a routing circuit or network 20 to left and right main speakers 22, 23 and to left and right auxiliary speakers 24, 25 in a manner to be described.

As shown, positive terminal 14 is connected via line 26 to positive input terminal 32 of the left main speaker 22 and via line 27 to positive terminal 35 of the right auxiliary speaker 25. Negative terminal 15 is connected via lines 28 and 29, shown dotted, to negative terminals 32' of the left main speaker 22 and negative terminal 35' of the right auxiliary speaker 25.

The right positive terminal 16 from the amplifier 12 is connected via line 30 to negative terminal 24' of left auxiliary speaker 24 and via line 31 to positive terminal 33 of the right main speaker. The negative terminal 17 is connected via line 37 to positive input terminal 34 of the left auxiliary speaker 24 and via line 38, shown dotted, to negative terminal 33' of the right main speaker 23. Thus, in the relationship described, a conventional stereo system having two speakers is combined with two auxiliary speakers in which the signal or sound information from one channel and connected to one of the main speakers in-phase is connected out-of-phase to one of the auxiliary speakers, and the information from the other channel is connected in-phase both to the other of the main speakers and the other of the auxiliary speakers. More particularly, there is a left main speaker 22 and left auxiliary speaker 24 in combination with a right main speaker 23 and a right auxiliary speaker 25, the left channel information being connected in-phase to the left main speaker and out-of-phase or, in other words, the polarity is reversed, to the right auxiliary speaker; and the right channel information is connected in-phase both to the right main speaker and to the left auxiliary speaker. Although the system is illustrated and described with the right channel information connected out-of-phase to the left auxiliary speaker and the left channel information connected in-phase to the right auxiliary speaker 25, the connection may be reversed such that the left channel information is connected out-of-phase to the right auxiliary speaker 25 and the right channel information is connected in-phase to left auxiliary speaker 24.

In FIGS. 1 and 2, the speaker system is illustrated in an enclosed area, such as for example, the room R which is made up of a floor surface represented at 40, ceiling 41, front wall 42, rear wall 43 and opposite sidewalls 44 and 45. A listener as represented at L is generally representative of one or more persons situated relatively near the front wall 42 and away from the rear wall 43, although the particular location of the listener or audience in the room is not critical to the invention. In turn, the stereophonic system is arranged such that the left and right main speakers 22 and 23, respectively, are situated on opposite sides of the room relatively near the left and right walls 44 and 45, respectively, and with the speakers facing or directed toward the front wall 42.

In order to enhance the quality of sound from the speaker system, the auxiliary speakers 24 and 25 are elevated with respect to the main speakers 22 and 23 and are positioned or directed such that the sound from each is reflected at different angles and caused to converge upon the ears of the listener or audience from different locations and out-of-phase with respect to one another. To this end, each of the auxiliary speakers 24 and 25 is mounted at the free end of a horizontal extension arm 48 of an upright standard or post 49 with the arm 48 extending forwardly and spaced above the main speaker for a distance above the floor such that the speakers 24 and 25 are located proximate to the ceiling 41 but spaced inwardly and forwardly of the main speakers 22 and 23. The left auxiliary speaker 24 is positioned such that the speaker cone 50 of the speaker is directed upwardly toward the ceiling 41 so that the sound generated by the speaker 24 is relected off of the ceiling surface. In turn, the auxiliary speaker 25 has its speaker cone 52 directed horizontally toward the sidewall 45 so that the in-phase signal generated by the speaker is reflected off of the sidewall 45, or at right angles to the out-of-phase signal emanating from the speaker 24.

In the relationship described, the front/rear spacing of the front auxiliary speakers 24 and 25 to the rear main speakers 22 and 23 in combination with the out-of-phase, reflected signals produced by the auxiliary speakers 24 and 25 converging upon the ear of the listener at different angles and phase and time intervals which has been found to achieve or produce high quality, pure and realistic sounds. In this relation, the direction of the speaker cones may be reversed, if desired, without detracting from the realism of the sound produced.

For the purpose of illustration but not limitation, for a room on the order of 10'×12' having a ceiling on the order of 8' high, most desirably the main speakers 22 and 23 are spaced approximately 8' apart, and the auxiliary speakers 24 and 25 are spaced approximately 5' in front of the main spaekers 22 and 23 and on the order of 6' apart and at an elevation of approximately 6' to 7'. Depending upon room size, sound-reflective surfaces other than the ceiling 41 and walls, such as, the walls 44 and 45 may be employed at selected spaced distances from the outlet ends of the speaker cones to produce the desired reflection of the signal or signals. Essentially, the different signals produced are the result of direct in-phase signals produced by the forwardly facing, main speakers, and the reflected in- and out-of-phase signals of the upwardly and sidewardly directed auxiliary speakers located above and forwardly of the main speakers. This arrangement results in greater musical definition, more solid instrument location and a definite recreation of room acoustics.

It is to be understood that various modifications and changes may be made in the specific location, facing and spacing of the speaker components making up the system of the present invention, such as, for example, an additional pair of auxiliary speakers to produce two additional signals having different phasing and source location from the four speakers as described to further enhance the production of sound, without departing from the spirit and scope of the present invention as defined by the appended claims.

I claim:

1. A multi-channel audio system for producing L and R stereo signals from an audio source for reception by a listening site proximate the audio source, the system comprising:

first and second speakers arranged in horizontally spaced relation to one another and facing in substantially the same direction, each speaker producing and directing one of said L and R signals in substantially the same direction;

third and fourth speakers positioned in front of said first and second speakers, first means for transmitting one of said L and R signals to one of said third and fourth speakers, and second means for transmitting the other of said L and R signals to the other of said third and fourth speakers, one of said L and R signals being transmitted in-phase and the other of said L and R signals being transmitted in out-of-phase relation to said third and fourth speakers;

one of said third and fourth speakers directing the sound produced by said in-phase signal at right angles to the sound produced by said out-of-phase signal and directed by the other of said third and fourth speakers; and means including a first sound-reflective surface for reflecting the sound produced from said in-phase signal and means including a second sound-reflective surface at right angles to said first sound reflective surface for reflecting the sound produced by said out-of-phase signal whereby four different signals are produced and directed by said first, second, third and fourth speakers from different locations and arrive at the listening site at spaced time intervals with respect to one another.

2. An audio system according to claim 1, wherein said third and fourth speakers are positioned in front of and above said first and second speakers.

3. An audio system according to claim 1, wherein said L signal is transmitted in-phase and said R signal is transmitted out-of-phase to said third and fourth speakers, respectively.

4. An audio system according to claim 1, wherein said system is positioned in an enclosure having a rear wall, a front wall, opposite side walls and a ceiling, said ceiling defining said first sound reflective surface and one of said side walls defining said second-sound reflective surface, said first and second speakers being situated relatively near said rear wall and away from said front wall.

5. An audio system according to claim 4, wherein said third and fourth speakers are elevated above and positioned in front of said first and second speakers.

6. A multi-channel audio system including amplifier means for producing L and R stereo signals from an audio source wherein a pair of first and second speakers are arranged in horizontally spaced relation to one another within a common enclosure having a rear wall, front wall, opposite side walls and a ceiling, the combination therewith comprising:

a pair of third and fourth auxiliary speakers positioned in front of and above said first and second speakers in said enclosure, first means for transmitting one of said L and R signals to one of said first and second speakers and to one of said third and fourth speakers, and second means for transmitting the other of said L and R signals to the other of said first and second speakers and to the other of said third and fourth speakers, said first means transmitting said L signals as in-phase signals to said first speaker and said fourth speaker and said second means transmitting said R signals as in-phase signals to said second speaker and as out-of-phase signals to said third speaker;

said fourth speaker directing said in-phase signals at right angles to said out-of-phase signals delivered by said third speaker, means including one of said side walls for reflecting said in-phase signals from said fourth speaker, and means including said ceiling for reflecting said out-of-phase signals delivered from said third speaker whereby four signals are produced by said first, second, third and fourth speakers from different locations in said enclosure and arrive at the same listening site at spaced time intervals.

7. A multi-channel audio system according to claim 6, wherein said first and second speakers are spaced farther apart from one another than the spacing between said third and fourth speakers, and the sound produced by said first and second speakers is directed toward said front wall.

8. A multi-channel audio system according to claim 6, said amplifier means including a left channel provided with positive and negative output terminals and a right channel provided with positive and negative output terminals, said first and second means for transmitting said L and R signals being a signal-routing circuit, each of said first, second, third and fourth speakers having positive and negative terminals, said second means connecting said right channel positive and negative output terminals to the negative and positive output terminals, respectively, of said third speaker whereby said R signals are transmitted as out-of-phase signals to said third speaker.

9. A multi-channel audio system for producing L and R stereo signals from an audio source for reception at a listening site;

a sound producing and listening space including at least a horizontally extending sound reflective surface positioned in vertical spaced relation with respect to the listening site;

first and second speakers positioned within the space, arranged in horizontally spaced relation to one another and facing toward the listening site, the first and second speaker being in phase with one speaker connected to the L channel, the other speaker being connected to the R channel to direct first and second signals toward the listening site;

at least one additional speaker positioned within the space and connected in out-of-phase relation to the system relative to one of the first and second speakers; and means for positioning the additional speaker above the first and second speakers, in spaced relation to the horizontally extending surface and between the first and second speakers and the listening site with the speaker facing upward toward the sound reflective surface to produce and direct a third signal toward the sound reflective surface, whereby at least three different signals are produced and directed by said first second and third speakers from different locations with at least the third signal arriving at the listening site at a spaced time interval with respect to the first and second signals.

* * * * *